US007694824B2

(12) United States Patent
Bae

(10) Patent No.: US 7,694,824 B2
(45) Date of Patent: Apr. 13, 2010

(54) CLAM SHELL TYPE RECEPTACLE

(75) Inventor: Hae Dong Bae, Anyang (KR)

(73) Assignee: Taesung Industrial Co., Ltd., Anyang, Kyungki-Do (KR)

( * ) Notice: Subject to any disclaimer, the term of this patent is extended or adjusted under 35 U.S.C. 154(b) by 113 days.

(21) Appl. No.: 12/018,564

(22) Filed: Jan. 23, 2008

(65) Prior Publication Data

US 2009/0145795 A1 Jun. 11, 2009

(30) Foreign Application Priority Data

Dec. 6, 2007 (KR) ..... 10-2007-0126119

(51) Int. Cl.
*A45D 33/00* (2006.01)

(52) U.S. Cl. ..... 206/581; 206/530; 220/833

(58) Field of Classification Search ..... 206/472, 206/581, 6, 530, 531, 536, 1.5; 132/293–297; 220/324–326, 833–835

See application file for complete search history.

(56) References Cited

U.S. PATENT DOCUMENTS 4,774,973 A * 10/1988 Gueret ..... 220/326
4,989,622 A * 2/1991 Kozuka et al. ..... 132/301
5,682,910 A * 11/1997 Kizawa et al. ..... 132/293
2005/0241987 A1 * 11/2005 Dieudonat ..... 206/581

* cited by examiner

*Primary Examiner*—Ehud Gartenberg
*Assistant Examiner*—Ernesto A Grano
(74) *Attorney, Agent, or Firm*—Lowe Hauptman Ham & Berner, LLP

(57) ABSTRACT

A clam shell type receptacle includes: a case assembly including a bottom case and a top case, the bottom case having a bottom wall and a peripheral wall which together form a recessed reception space, and the top case having a top wall and a peripheral wall which together form a recess, the top case being coupled to the bottom case so as to open or close the reception space; and a locking and release unit for locking the reception space in the closed state and for releasing the reception space from the locked state. The disclosed receptacle has a simplified external appearance, can be easily opened or closed, and the closed state of the reception space can be stably maintained.

1 Claim, 13 Drawing Sheets

CLAM SHELL TYPE RECEPTACLE

BACKGROUND OF THE INVENTION

1. Field of the Invention

The present invention relates to a clam shell type receptacle, and more particularly to a receptacle having a bottom case forming a recessed reception space, and a top case coupled to the bottom case for opening and closing the reception space.

2. Description of the Prior Art

As generally known in the art, conventional cosmetic receptacles, such as a cosmetic makeup compact, are formed with a space for holding cream or powder cosmetics. Among such cosmetic receptacles, a clam shell type receptacle has a construction allowing a reception space formed in a bottom case to be opened or closed by a top case.

FIG. 12 is a cross-sectional view of a conventional clam shell type receptacle.

As shown in FIG. 12, a conventional clam shell type receptacle includes a case assembly 110 forming a reception space 120*a*, a locking and release unit 140 for locking the case assembly 110 so that the reception space 120*a* is closed in relation to the outside, or for releasing the case assembly 110 from the locked state, and an inner receptacle 160 provided within the case assembly 110.

The case assembly 110 has a bottom case 120 and a top case 130 coupled to the bottom case 120.

The bottom case 120 has a bottom wall 121 and a peripheral wall 122, the bottom wall 121 and the peripheral wall 122 cooperatively forming a recessed reception space 120*a*.

An opening assistance groove 122*a* is formed on the front side of the peripheral wall 122 of the bottom case 120.

The top case 130 has a top wall 131 and a peripheral wall 132, the top wall 131 and the peripheral wall 132 cooperatively forming a recessed area.

The top case 130 with the above-mentioned construction is pivotally coupled to the bottom case 120.

Consequently, as the top case 130 is pivoted, the reception space 120*a* of the bottom case 120 is opened or closed.

The locking and release unit 140 includes a catch projection 141 formed in the opening assistance groove 122*a*, and a locking rib 152 extending downward from the front lower edge of the peripheral wall 132 of the top case 130.

The locking rib 152 has a locking projection 152*a* formed on the inner surface of the locking rib 152.

A method of using the above-mentioned conventional clam shell type receptacle will be described with reference to FIG. 13. For the convenience of description, it is assumed that the reception space 120*a* is opened.

At first, if the top case 130 is pushed toward the bottom case 130, the top case 120 is rotated.

As the top case 130 is rotated, the locking rib 152 is received within the opening assistance groove 122*a*, and the locking projection 152*a* comes into contact with the catch projection 141.

When the locking projection 152*a* comes into contact with the catch projection 141, the top case 130 is pressed so that the locking projection 152*a* is forced to move over the catch projection 141. If the locking projection 152*a* is moved over the catch projection 141, the reception space 120*a* is closed and maintained in the closed state through the cooperation of the locking projection 152*a* and the catch projection 141.

Next, if the top case 130 is rotated away from the bottom case 120 with the opening assistance groove 122*a*, the locking projection 152*a* is released from the catch projection 141, and the reception space 120*a* is opened.

The above-mentioned conventional clam shell type receptacle has a problem in that its outer appearance is complicated because the locking and release unit 140 is formed on the outer surface of the case assembly 110.

In addition, the clam shell type receptacle has a problem in that because it is necessary to move the locking projection 152*a* over the catch projection 141 when the reception space 120*a* is opened or closed, the locking projection 152*a* and the catch projection 141 are worn.

Moreover, the clam shell type receptacle has a problem in that because the locking projection 152*a* and the catch projection 141 are worn when the reception space 120*a* is opened or closed, it is impossible to stably maintain the closed state of the reception space 120*a* if the clam shell type receptacle is used for a long time.

SUMMARY OF THE INVENTION

Accordingly, the present invention has been made to solve the above-mentioned problems occurring in the prior art, and an object of the present invention is to provide a clam shell type receptacle which is simple in external appearance and has an easily opened and closed reception space, the closed state of the reception space being stably maintained.

In order to accomplish this object, there is provided a clam shell type receptacle including: a case assembly including a bottom case and a top case, the bottom case having a bottom wall and a peripheral wall which together form a recessed reception space, and the top case having a top wall and a peripheral wall which together form a recess, the top case being coupled to the bottom case so as to open or close the reception space; and a locking and release unit for locking the reception space in the closed state and for releasing the reception space from the locked state, wherein the top wall has a button opening formed at the central area thereof, and the locking and release unit includes: a button engaged with the top case in such a manner that one end of the button can be moved toward the bottom wall through the button opening when the button is pressed toward the bottom wall; a catch wall vertically formed on the bottom wall so that the catch wall is arranged between the moving end of the button and the peripheral wall of the bottom case, the catch wall having a catch groove at a surface opposite to the peripheral wall of the bottom case; an actuation member having a head and a leg extending from the head, the leg having a locking projection formed at the longitudinal end thereof, the actuation member being installed within the case assembly in such a manner that when the button is pressed, the head is moved toward the peripheral wall of the bottom case, and when the head is moved toward the peripheral wall of the bottom case, the locking projection is released from the catch groove; and an elastic return member interposed between the actuation member and the case assembly so that when the head is moved toward the peripheral wall of the bottom case, the elastic return member accumulates elastic force.

In order to simplify the construction of the locking and release unit, it is desired that the elastic return member includes a pair of elastic return arms formed on the opposite lateral sides of the head and extending away from each other, the elastic return arms being supported by the top case so that they accumulate elastic force when the head is moved toward the peripheral wall of the bottom case.

In addition, in order to allow the introduction of the leg between the peripheral wall of the bottom case and the catch wall to be guided, it is desired that the catch wall has a guide slope at the top thereof, thereby guiding the downward movement of the leg when the top case approaches the bottom case so as to close the reception space.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
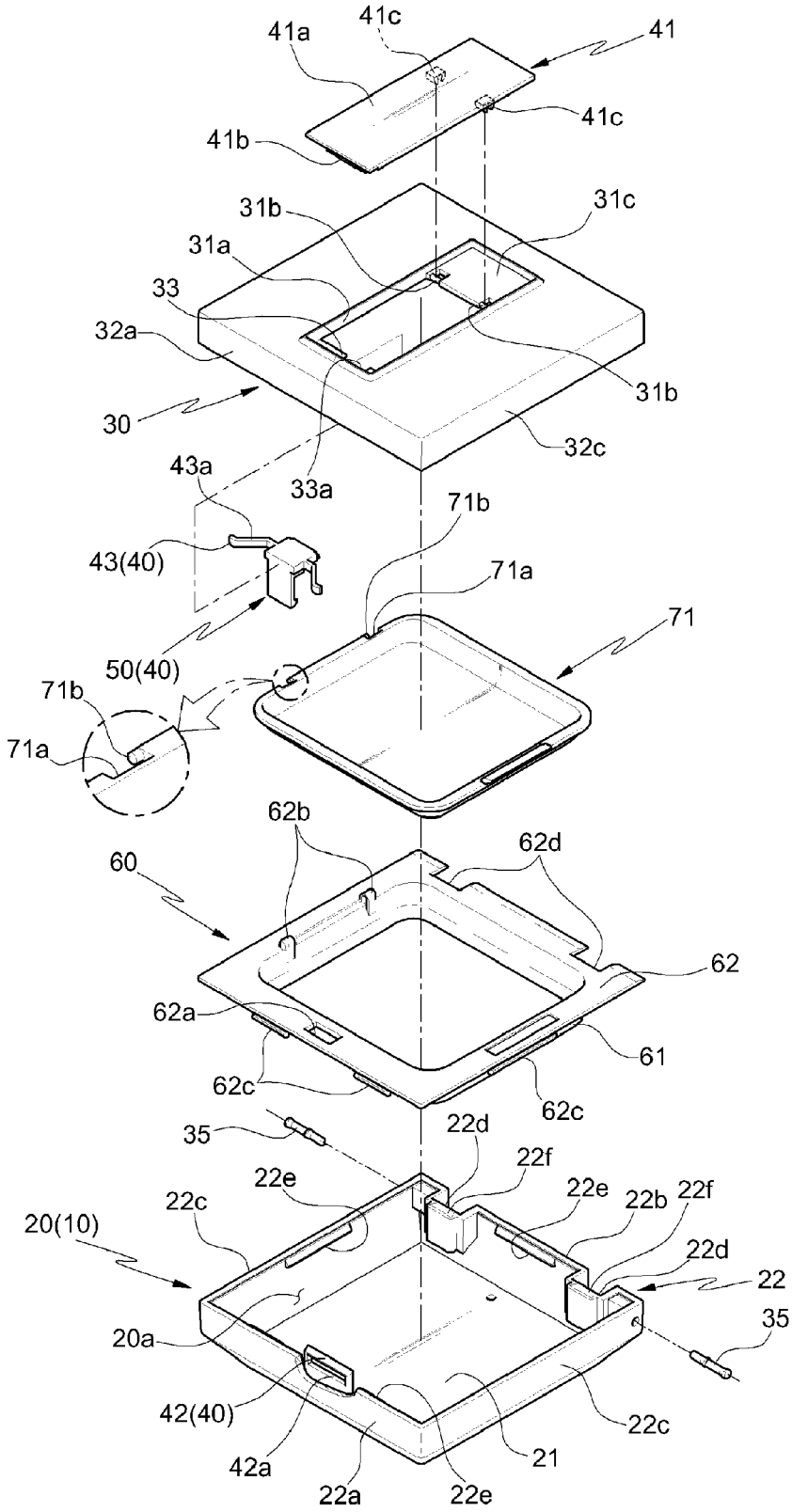
FIGS. 1 and 2 are exploded perspective views of a clam shell type receptacle according to an embodiment of the present invention viewing the receptacle from the upper and lower sides of the receptacle, respectively.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 2:
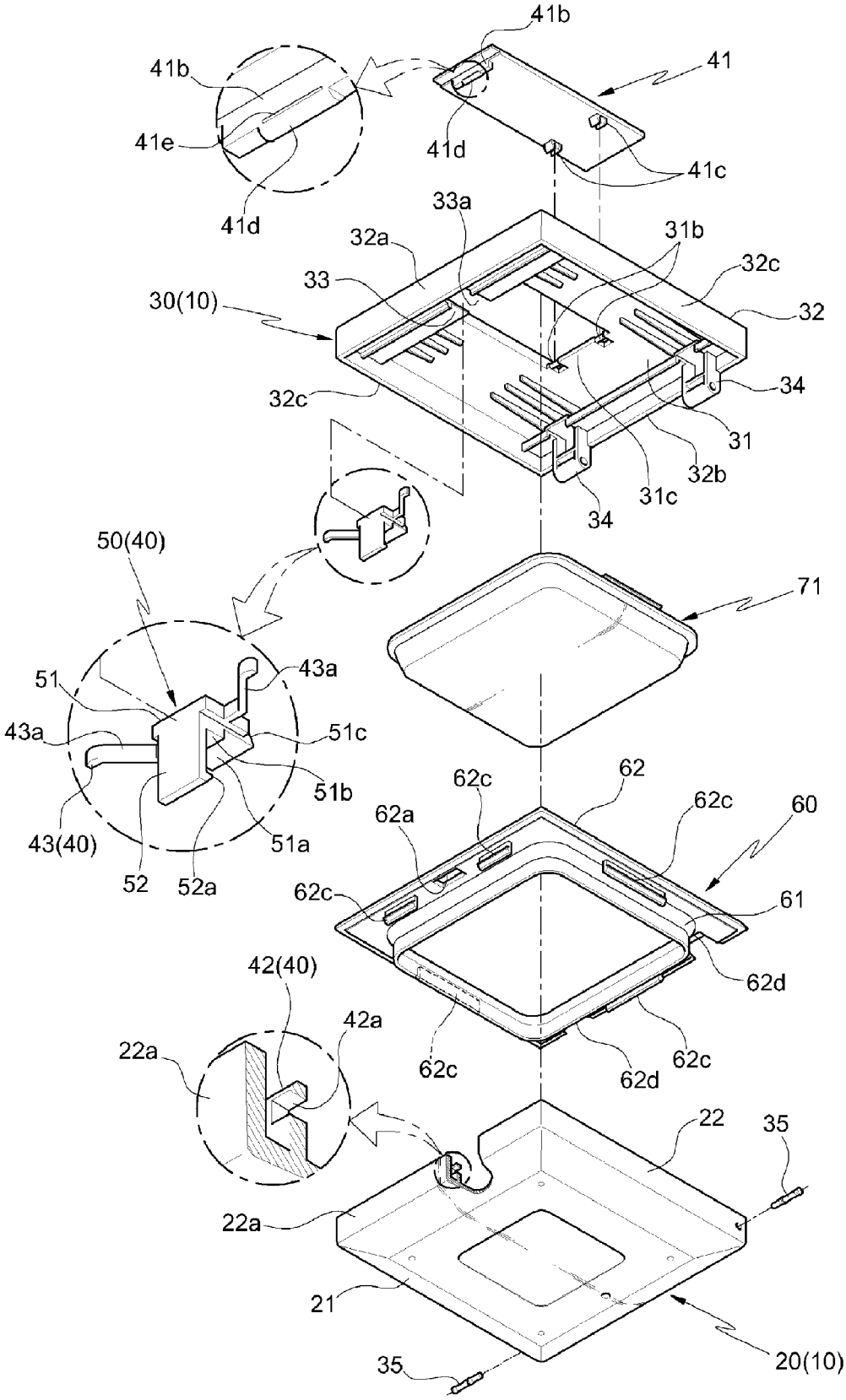
Figure 3:
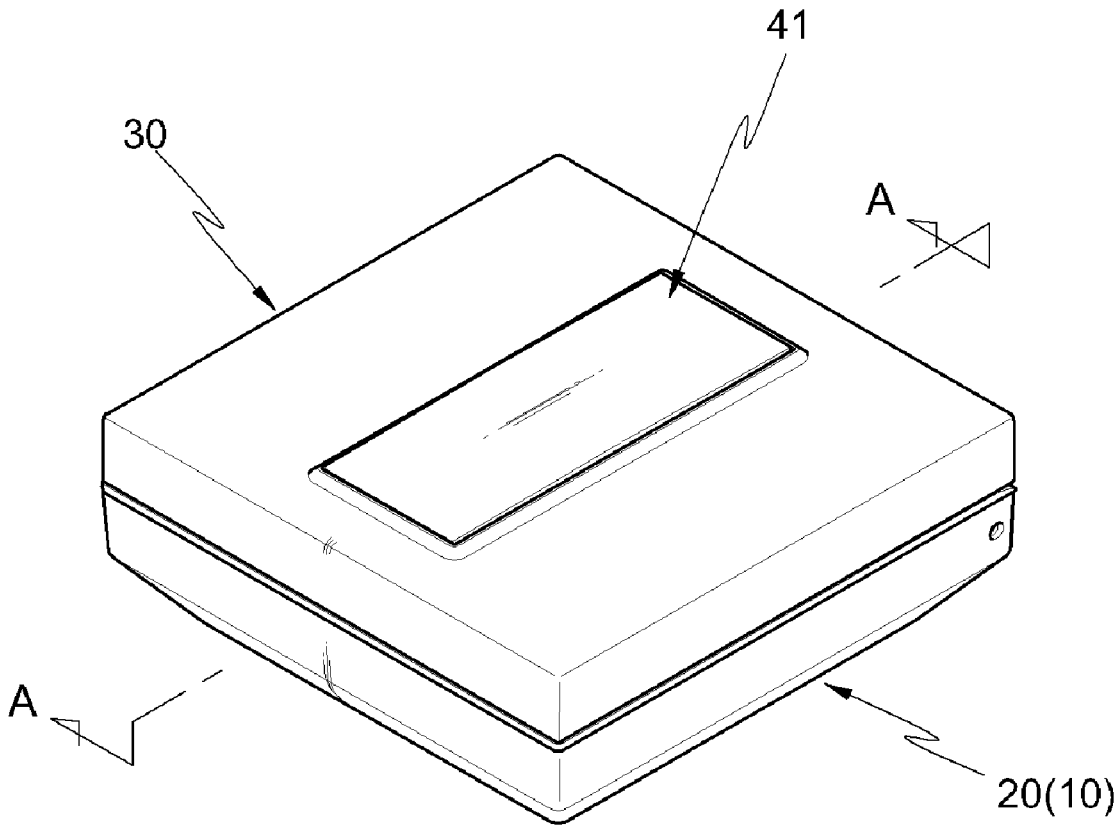
FIG. 3 is a perspective view showing the clam shell type receptacle of FIGS. 1 and 2 in the assembled state.
Figure 4:
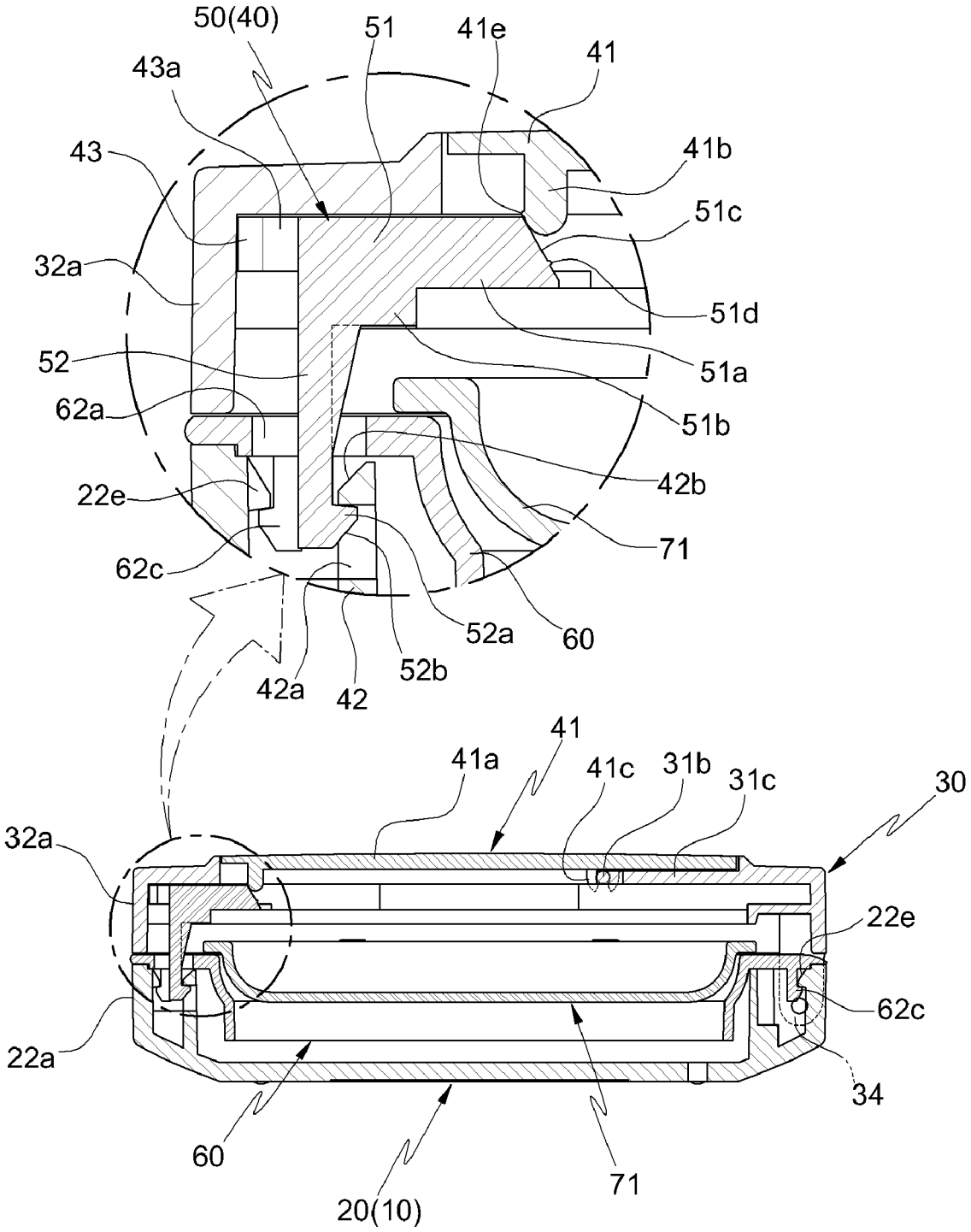
FIG. 4 is a cross-sectional view taken along line A-A' of FIG. 3.
Figure 5:
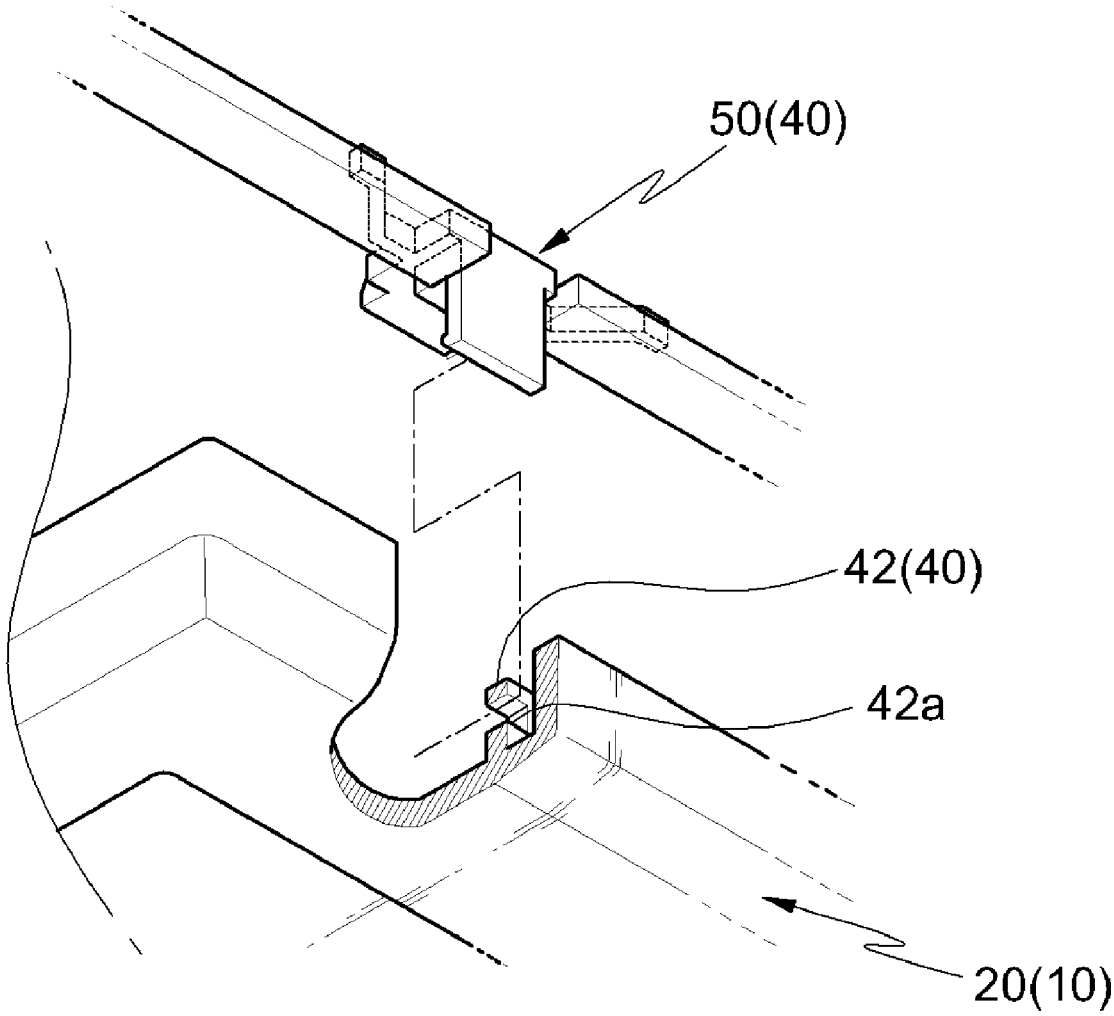
FIGS. 5 and 6 show the actuation member and the elastic return arm of FIGS. 1 and 2 in the assembled state, respectively.
Figure 6:
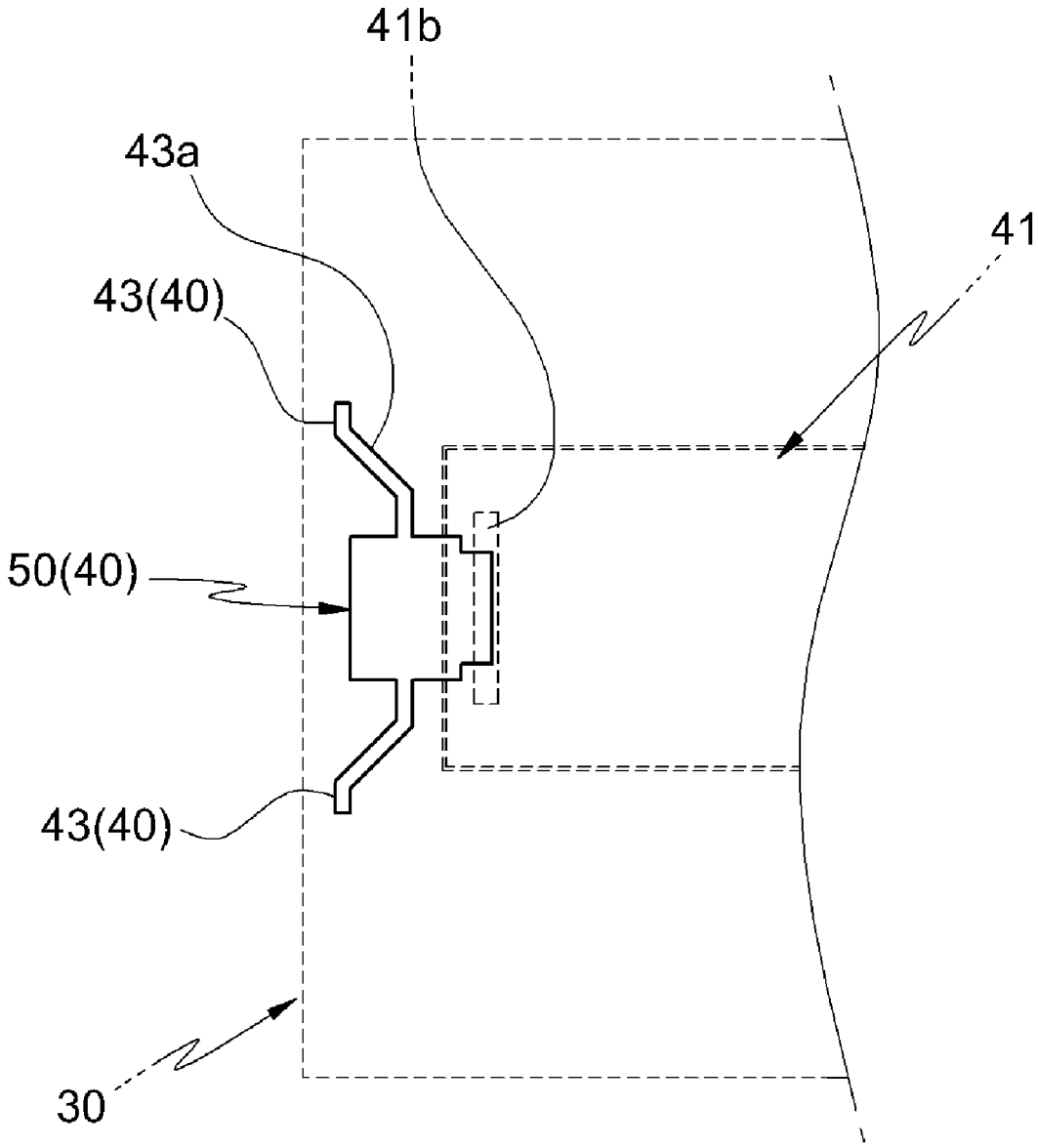

FIGS. 1 and 2 are exploded perspective views of a clam shell type receptacle according to an embodiment of the present invention viewing the receptacle from the upper and lower sides of the receptacle, respectively, and FIG. 3 is a perspective view showing the clam shell type receptacle of FIGS. 1 and 2 in the assembled state. In addition, FIG. 4 is a cross-sectional view taken along line A-A' of FIG. 3, and FIGS. 5 and 6 show the actuation member and the elastic return arm of FIGS. 1 and 2 in the assembled state, respectively.

As shown in the drawings, the clam shell type receptacle according to an embodiment of the present invention includes a case assembly 10 forming a reception space 20*a*, a locking and release unit 40 for locking the reception space 20*a* of the case assembly 10 in the closed state in relation to the outside and for releasing the reception space 20*a* from the locked state, a receptacle support 60 positioned within the case assembly 10, and an internal receptacle 71 mounted on the receptacle support 60.

The case assembly 10 has a bottom case 20 and a top case 30 coupled to the bottom case 20.

The bottom case 20 has a bottom wall 21 and a peripheral wall 22, the bottom wall 21 and the peripheral wall 22 forming the reception space 20*a* which is recessed.

The peripheral wall 22 of the bottom case 20 has a front wall part 22*a* and a rear wall part 22*b* which are parallel to each other, and a pair of lateral wall parts 22*c* interposed between the front and rear wall parts 22*a* and 22*b*.

A pair of case coupling recesses 22*d* are formed at the opposite ends of the rear wall part 22*b*.

An elastic member 22*f* is provided in each of the case coupling recesses 22*d*.

A plurality of anchoring ridges 22*e* are distributed on the internal surface of the peripheral wall 22 of the bottom case 20.

The top case 30 has a top wall 31, a peripheral wall 32, the top wall 31 and the peripheral wall 32 of the top case 30 forming a recess, a support plate 33 affixed to the internal surface of the front wall part 32*a* of the peripheral wall 32 of the top case 30 to be parallel to the top wall 31, and a pair of engagement ribs 34 vertically formed on the bottom side of the top wall 31.

The top wall 31 has a rectangular button opening 31*a* formed at the central area thereof, and a button pivot pin 31*b* is formed on each side of the button opening 31*a*.

The top wall 31 has a pair of abutments 31*c*, each being formed at the rear area of each of the button pivot pins 31*b*.

The peripheral wall 32 of the top case 30 has front and rear walls part 32*a* and 32*b*, which are parallel to each other, and a pair of lateral wall parts 32*c* interposed between the front and rear wall parts 32*a* and 32*b*.

The support plate 33 is cut at the central area thereof, thereby forming a guide groove 33*a*.

The top case 30 with the above-mentioned construction is assembled to the bottom case 20 by a pair of case pivot pins 35, each being fitted through one of a pair of case coupling projections 34 and one of the above-mentioned case coupling recesses 22*d*.

As a result, if the top case 30 is pivoted, the reception space 20*a* can be opened or closed.

The locking and release unit 40 has a button 41 coupled to the top wall 31, a catch wall 42 vertically formed on the bottom wall 21, an actuation member 50 installed within the case assembly 10, and an elastic return arm 43 interposed between the actuation member 50 and the top case 30, The button 41 has a push plate 41*a*, a press wall 41*b* formed on the bottom of the push plate 41*a*, and a pair of pin grooves 41*c*.

The press wall 41*b* has a press projection 41*d* formed at the central area thereof, and a catch rib 41*e* formed in front of the press projection 41*d*.

The press projection 41*d* is arranged in such a manner that when the push plate 41*a* is pivoted toward the bottom wall 21, the press projection 41*d* can press a head 51, which will be described later.

The button 41 with the above-mentioned construction is installed in such a manner that each of the button pivot pin 31 is inserted into one of the pin grooves 41*c*, and the bottom of the button 41 is supported by the top of the abutments 31*c*.

As a result, if the button 41 is pressed toward the bottom wall 21, the front end of the push plate 41*a* is movable toward the bottom wall 21 through the button opening 31*a*.

The catch wall 42 is formed in such a manner that it is arranged between the moving end (front end) of the push plate 41*a* and the front wall part 22*a* of the peripheral wall 22 of the bottom case 20, and the catch wall 42 has a catch groove 42*a* formed on the surface of the catch wall 42 opposite to the front wall part 22*a*.

In addition, the catch wall 42 has a guide slope 42*b* formed on the top thereof. Here, the guide slope 42*b* comes into surface contact with a slide slope to be described later, thereby guiding the downward movement of a leg 52 to be described later when the top case 30 approaches the bottom case 20 so as to close the reception space 20*a*.

The actuation member 50 has a head 51 and a leg 52 extending from the head 51.

The head 51 has a sliding plate part 51*a*, and a guide plate part 51*b* formed in front of the sliding plate part 51*a*.

The sliding plate part 51*a* is cut away at the opposite rear edge areas thereof, thereby forming downward acting slopes 51*c* between the cut away areas.

The guide plate part 51*b* is formed to have a width narrower than that of the sliding plate part 51*b*.

The leg 52 is vertically extending from the guide plate part 51*b*, and a locking projection 52*a* is formed at the longitudinal end of the leg 52.

In addition, the leg 52 has a sliding slope 52*b* formed at the longitudinal end thereof, and the sliding slope 52*b* is parallel to the guide slope 42*b*.

The actuation member 50 with the above-mentioned construction is installed in such a manner that the sliding plate part 51*a* is supported on the top of the support plate 33, the guide plate part 51*b* is inserted into the guide groove 33*a*, the leg 52 is introduced between the catch wall 42 and the peripheral wall 22 of the bottom case 20, and the locking projection 52*a* is inserted into the catch groove 52*a*.

In addition, the actuation member 50 is installed in such a manner that the press projection 41*d* comes into contact with the acting slope 51*c*.

As a result, if the button 41 is pressed toward the bottom wall 21 of the bottom case 20, the head 51 is moved toward the front wall part 22*a* of the peripheral wall 22 of the bottom case 20 by the cooperation of the press projection 41*d* and the acting slope 51*c*, and while the head 51 is moved toward the front wall part 22*a* of the peripheral wall 22 of the bottom case 20, the locking projection 52*a* is released from the catch groove 42*a*.

The elastic return arms 43 are formed on the opposite sides of the sliding plate part 51*a* and extend away from each other.

Each of the elastic return arms 43 are curved twice, forming one inclined area.

Each of the elastic return arms 43 with the above-mentioned construction is installed in such a manner that its free end is supported by the inner surface of the front wall part 32*a* of the peripheral wall 32 of the top case 30.

As a result, the elastic return arms 43 can accumulate elastic force when the head 51 is moved toward the front wall part 32*a* of the peripheral wall 32 of the top case 30.

The receptacle support 60 has a tubular body 61, and a support flange 62 formed around and projecting from the entire peripheral area of the top end of the tubular body 61.

The support flange 62 has a passage hole 62*a* formed at the front part thereof, and a pair of passage recesses 62*d* formed by partially cutting the rear part thereof.

The passage 62*a* is formed on the moving route of the leg 52.

In addition, the support flange 62 has a pair of support projections 62*b* formed at the left part of support flange 62, and a plurality of anchoring ribs 62*c* formed on and dispersed around the bottom of the support flange 62.

The receptacle support 60 with the above-mentioned construction is installed in such a manner that the support flange 62 is supported by the catch wall 42 and the peripheral wall 22 of the bottom case 20, and the anchoring ribs 62*c* are engaged with the anchoring ridges 22*e*, respectively. Here, the receptacle support 60 is installed in such a manner that the passage recesses 62*d* are arranged above the case coupling recesses 22*d*.

The internal receptacle 71 has a pair of cap coupling recesses 71*a* formed at the left part thereof.

The internal receptacle 71 with the above-mentioned construction engaged with the support projections 62*b* through cap coupling projections 71*b*, each of the cap coupling projections 71*b* being formed in one of the cap coupling recesses 71*a*.

A method of using the clam shell type receptacle with the above-mentioned construction will be described with reference to FIGS. 7 to 11. For the convenience of description, it is assumed that the reception space 20*a* is opened (see FIG. 7).

At first, the top case 30 is pivoted toward the bottom case 20.

If the top case 30 is pivoted toward the bottom case 20, the leg 52 is guided by the guide slope 42*b*, entering between the catch wall 42 and the peripheral wall 22 of the bottom case 20.

While the leg 52 is entering between the catch wall 42 and the peripheral wall 22 of the bottom case 20, the elastic return arms 43 accumulate elastic force, by which the locking projection 52*a* is introduced into the catch groove 42*a*.

If the locking projection 52*a* is introduced into the catch groove 42*a*, the reception space 20*a* is closed, and the closed state of the reception space 20*a* is maintained by the cooperation of the locking projection 52*a* and the catch groove 42*a*.

Before the reception space 20*a* is closed, the top case 30 presses the elastic members 22*f*, which is in turn accumulated with elastic force.

Meanwhile, it is possible to open the closed reception space 20*a* in the following manner.

At first, if a user presses the button 41 toward the bottom wall 21 with the index finger, the press wall 41*b* is pivoted toward the bottom wall 21, and the press projection 41*d* is moved downward while pressing the acting slope 51*c*.

Figure 8:
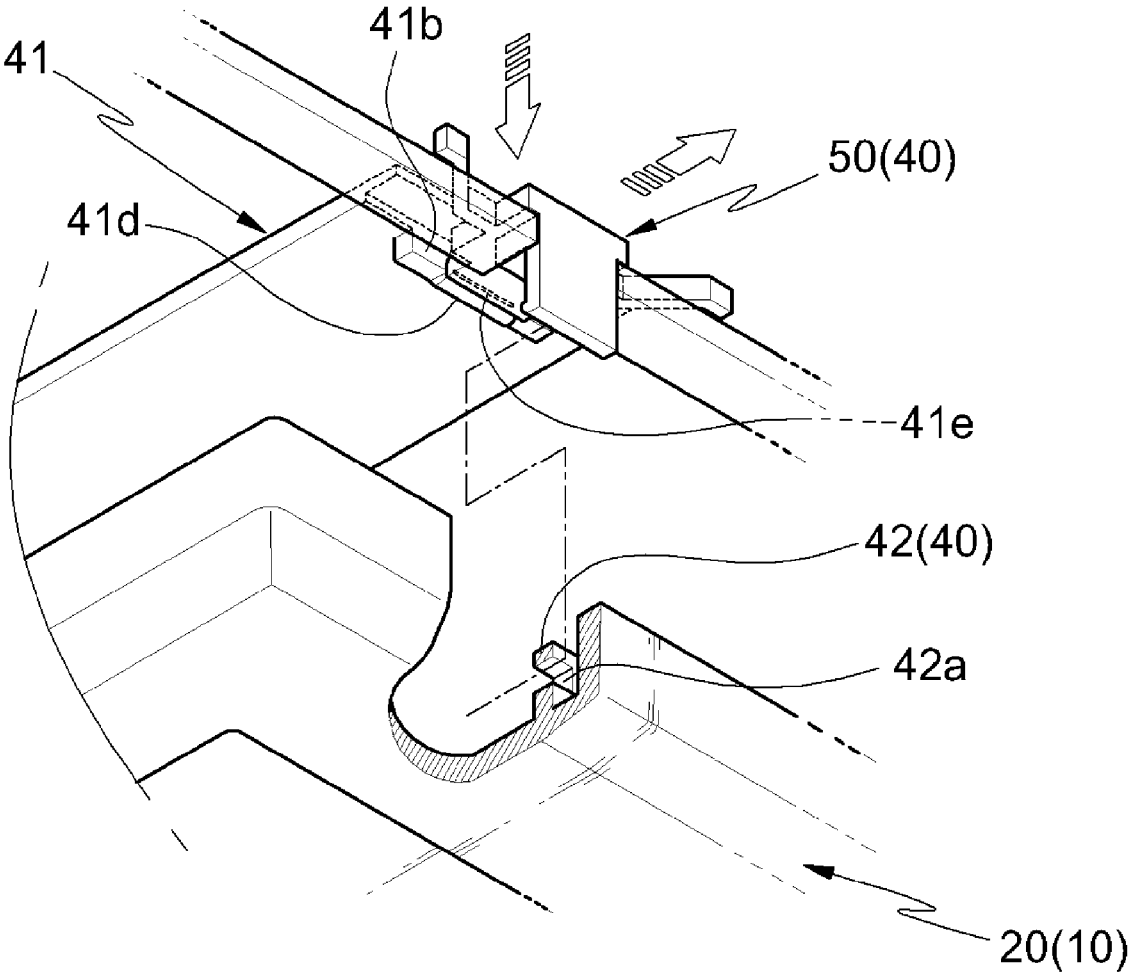
Figure 9:
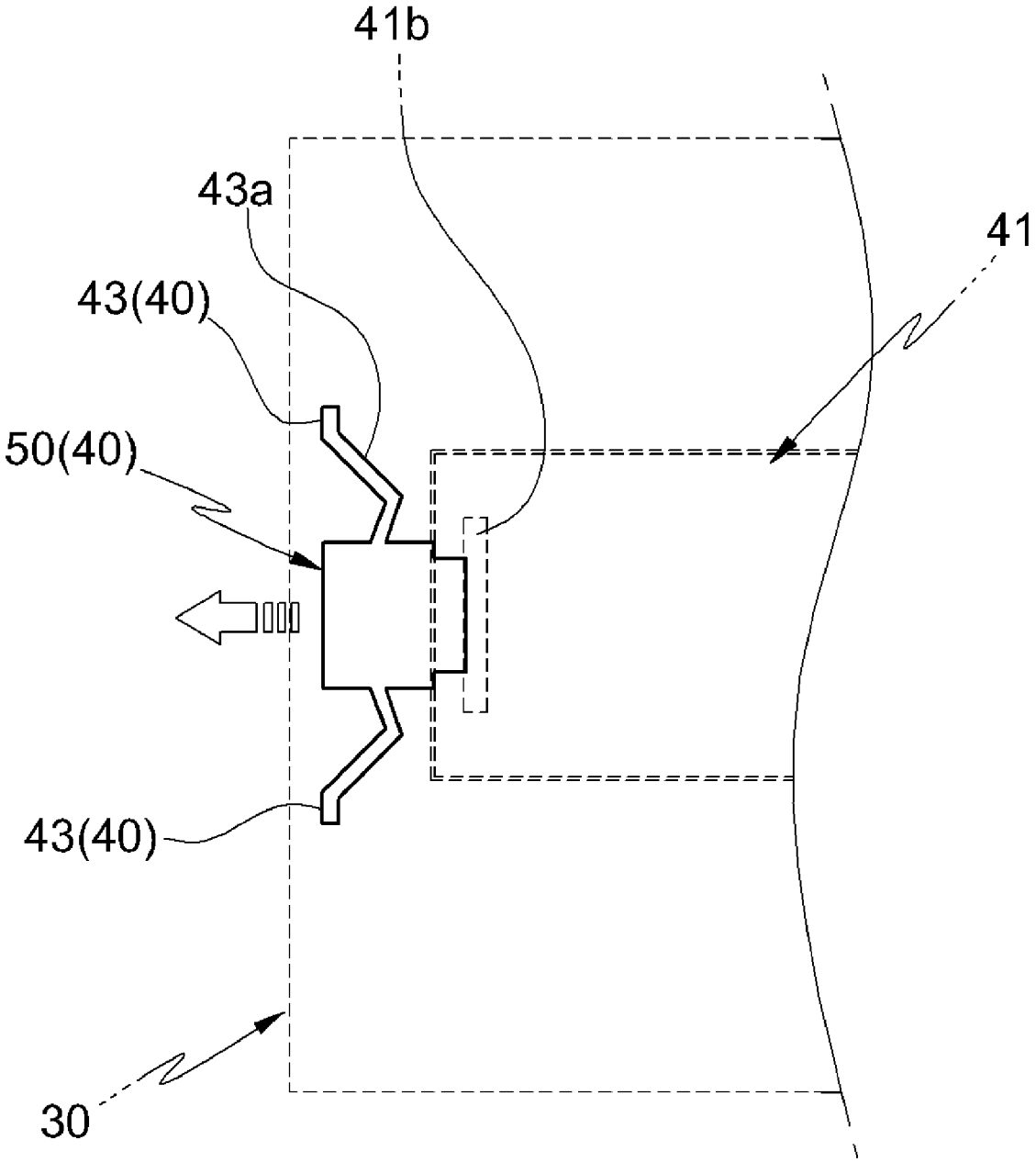
Figure 10:
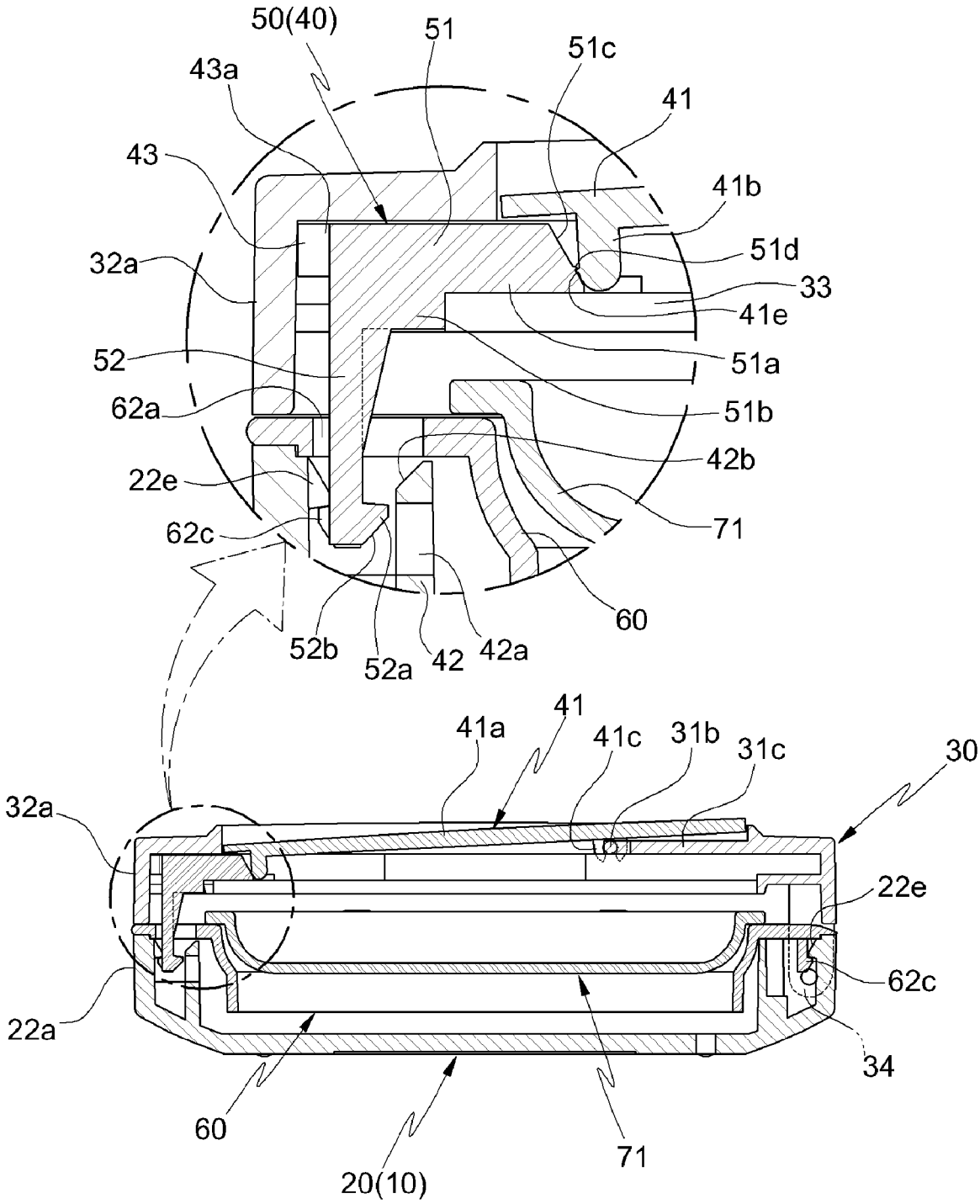

If the press projection 41*d* is moved downward, the actuation member 50 approaches the front wall part 22*a* of the peripheral wall 22 of the bottom case 20, and the locking projection 52*a* is released from the catch groove 42*a* (see FIGS. 8 to 10). As the actuation member 50 approaches the front wall part 22*a* of the peripheral wall 22 of the bottom case 20, the elastic return arms 43 accumulate elastic force.

Figure 11:
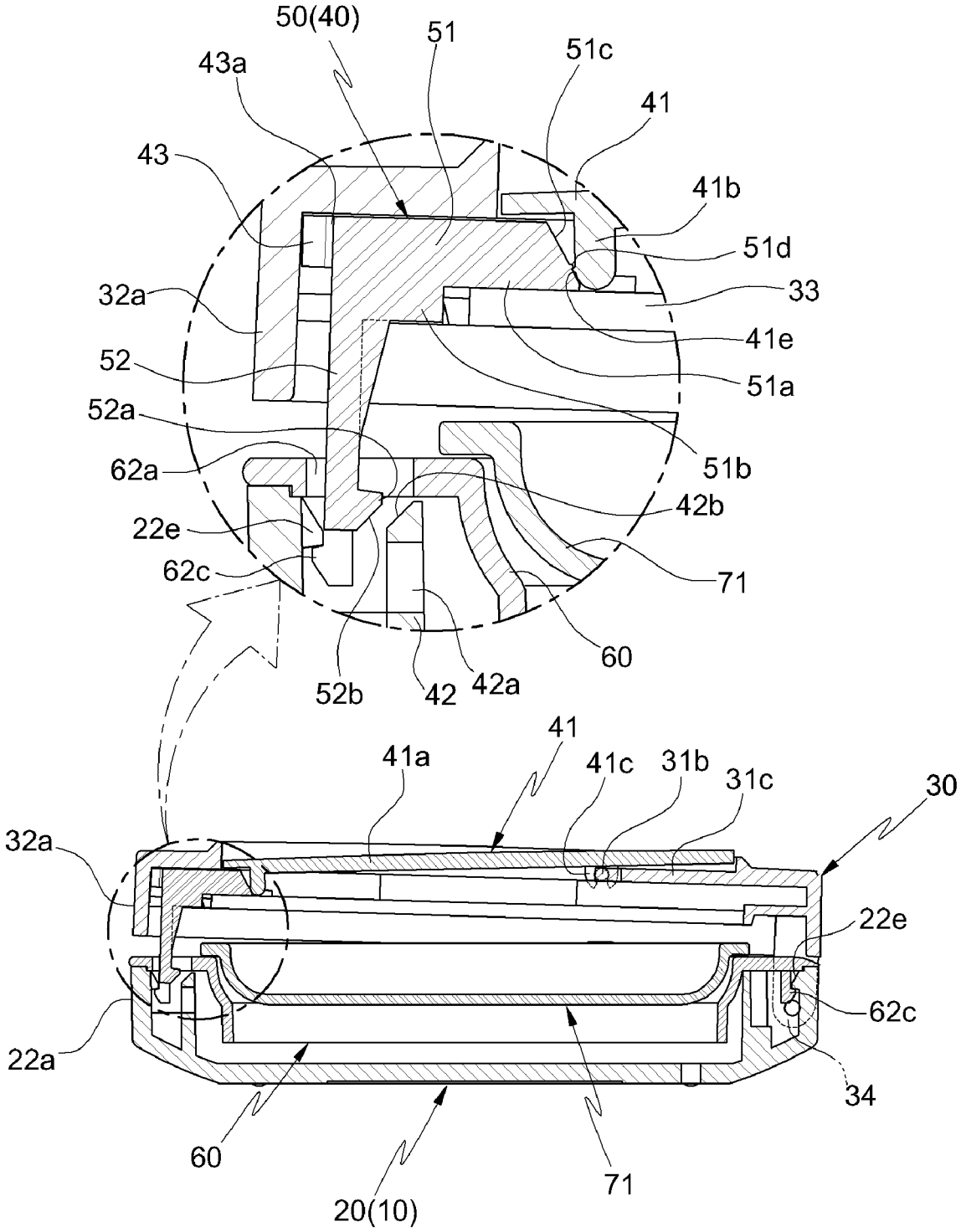
Figure 12:
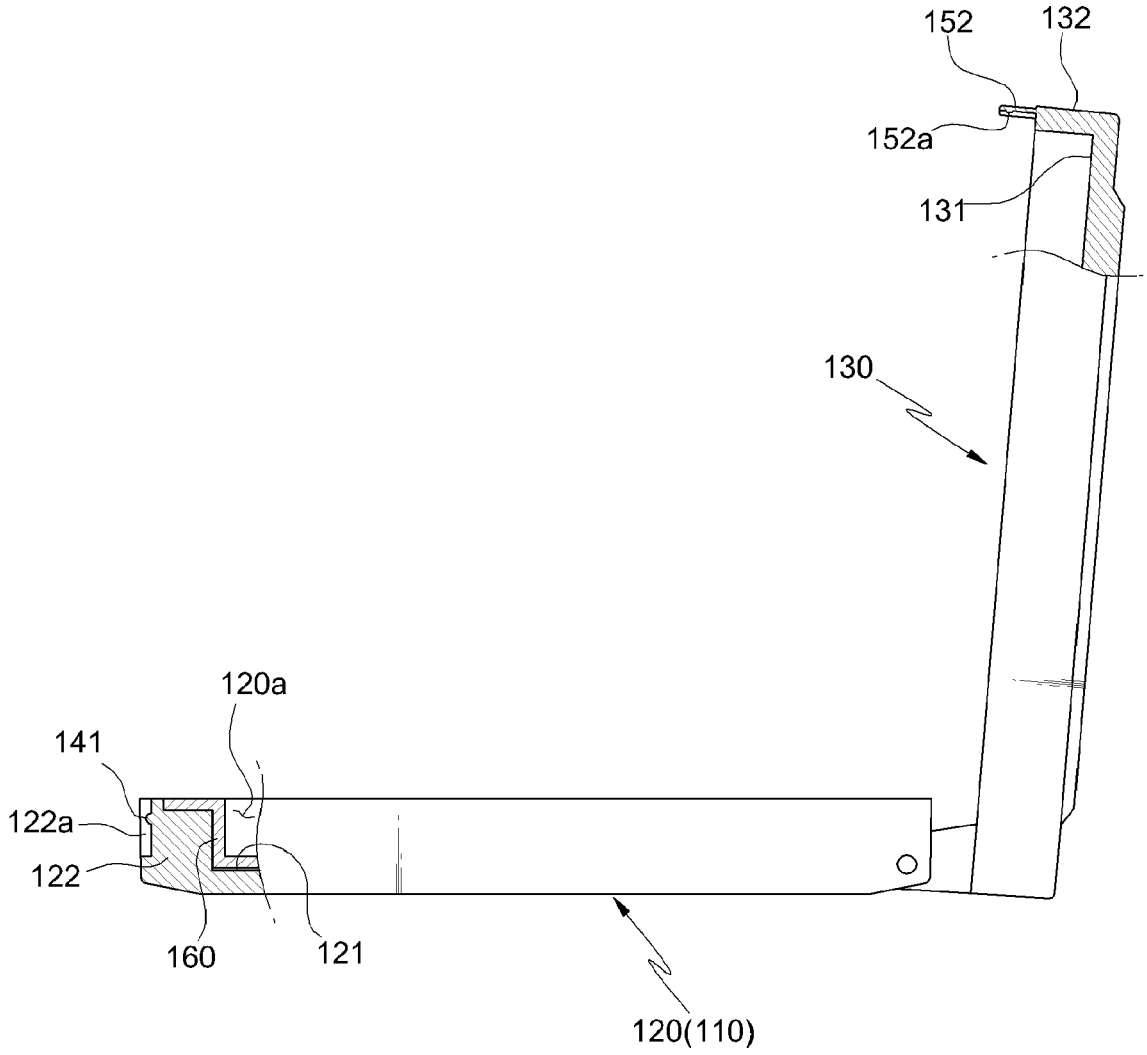
FIG. 12 PRIOR ART
FIG. 12 is a cross-sectional view of a conventional clam shell type receptacle.
Figure 13:
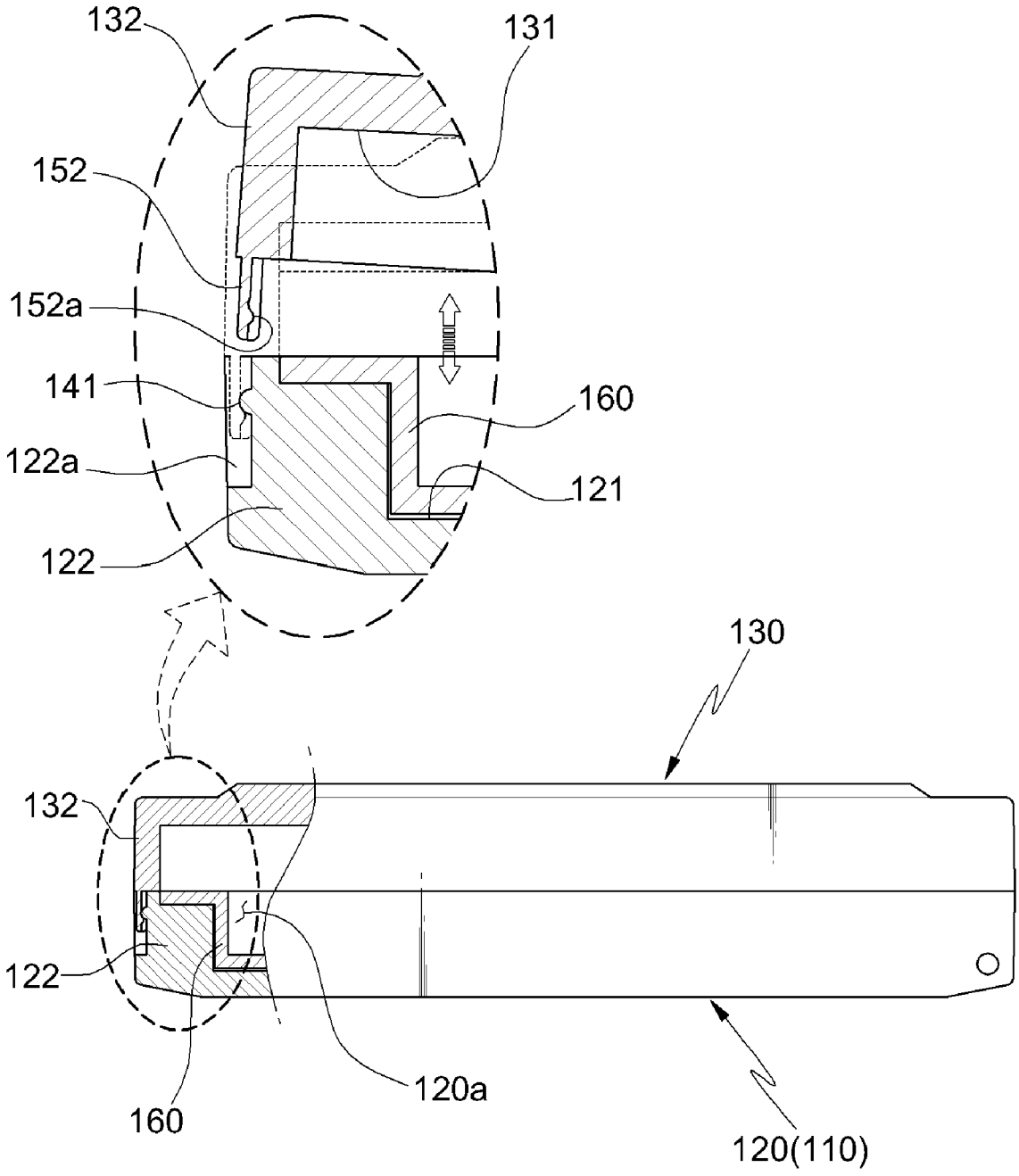
FIG. 13 PRIOR ART
FIG. 13 shows the operation of the locking and release unit of FIG. 12.

When the locking projection 52*a* is released from the catch groove 42*a*, the reception space 20*a* is partially opened by the elastic force accumulated in the elastic members 22*f* (see FIG. 11).

Next, the pressure applied to the button 41 is released in the state in which the reception space 20*a* is partially opened.

If the pressure applied to the button 41 is released, the actuation member 50 is returned to its original position by the elastic force accumulated in the elastic return arms 43.

Figure 7:
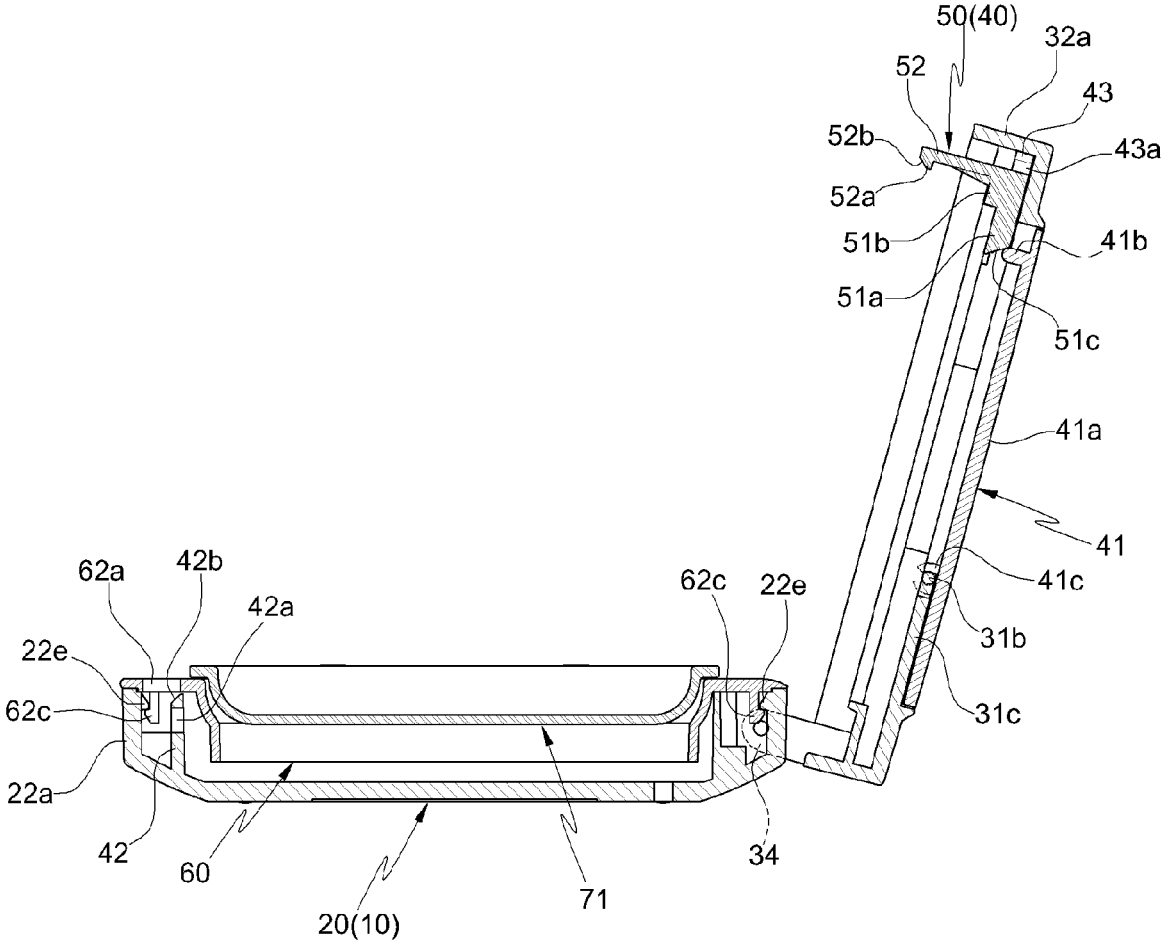
FIGS. 7 to 11 show a method of using the clam shell type receptacle of the above-mentioned embodiment of the present invention.

If the top case 30 is pivoted in the direction remote from the bottom case 20, the reception space 20*a* is fully opened (see FIG. 7).

As described above, according to the embodiment of the present invention, the external appearance of the case assembly 10 is simple because the locking and release unit 40 is provided within the case assembly 10.

In addition, because the locking projection 52*a* and the catch groove 42*a* are adapted to cooperate with each other through the pivot movement, the reception space 20*a* can be easily opened or closed, and the closed state of the reception space 20*a* can be stably maintained.

Meanwhile, because the elastic return arms 43 are integrally formed with the actuation member 50, the construction of the locking and release unit 40 can be simplified.

In conclusion, according to the present invention, the external appearance of the case assembly is simple because the locking and release unit is provided within the case assembly.

In addition, by arranging the locking projection and the catch groove to cooperate with each other through the pivot movement of the button, the opening and closing action of the reception space becomes easy, and the closed state of the reception space can be stably maintained.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A clam shell type receptacle comprising:

a case assembly including a bottom case and a top case, the bottom case having a bottom wall and a peripheral wall which together form a recessed reception space, and the top case having a top wall and a peripheral wall which together form a recess, the top case being coupled to the bottom case so as to open or close the reception space, and the top wall having a button opening formed at the central area thereof; and a locking and release unit for locking the reception space in a closed state and for releasing the reception space from a locked state, the locking and release unit comprising:

a button engaged with the top case in such a manner that one end of the button can be moved toward the bottom wall through the button opening when the button is pressed toward the bottom wall;

a catch wall vertically formed on the bottom wall so that the catch wall is arranged between the moving end of the button and the peripheral wall of the bottom case, the catch wall having a catch groove at a surface opposite to the peripheral wall of the bottom case;

an actuation member having a head and a leg extending from the head, the leg having a locking projection formed at a longitudinal end thereof, the actuation member being installed within the case assembly in such a manner that when the button is pressed, the head is moved toward the peripheral wall of the bottom case, and when the head is moved toward the peripheral wall of the bottom case, the locking projection is released from the catch groove; and an elastic return member interposed between the actuation member and the case assembly so that when the head is moved toward the peripheral wall of the bottom case, the elastic return member accumulates elastic force, wherein the elastic return member comprises a pair of elastic return arms formed on the opposite lateral sides of the head and extending away from each other, the elastic return arms being supported by the top case so that they accumulate elastic force when the head is moved toward the peripheral wall of the bottom case.

* * * * *